US006254445B1

(12) United States Patent
Jones

(10) Patent No.: US 6,254,445 B1
(45) Date of Patent: Jul. 3, 2001

(54) INFLATABLE CHEMICAL FOAM INJECTED BUOY

(75) Inventor: Anthony D. Jones, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/591,860

(22) Filed: Jun. 12, 2000

(51) Int. Cl.[7] ..... B63B 22/00

(52) U.S. Cl. ..... 441/1; 441/30

(58) Field of Search ..... 441/1, 6, 30, 31

(56) References Cited

U.S. PATENT DOCUMENTS 3,616,775 * 11/1971 Holter ..... 441/31
4,405,099 * 9/1983 Bolen ..... 441/30
4,406,631 * 9/1983 Dale ..... 441/30

* cited by examiner

*Primary Examiner*—Stephen Avila
(74) *Attorney, Agent, or Firm*—Harvey A. Gilbert; Donald G. Peck

(57) ABSTRACT

A lightweight inflatable marker buoy system is resistant to deflation and sinking if punctured. This device will most likely be used by a diver while underwater, but could be air delivered or dropped over the side of a boat and be activated by a timer or on command by electronic or acoustic means. A pair of chemical injector/cartridges each contains pressurized gas and a different chemical compound of a binary chemical compound for producing foam. A housing mounts the pair of chemical injector/cartridges on it and has a chamber to mix the pressurized gas and different compounds of the binary chemical compound to produce the foam. A balloon or flexible, compliant bag coupled to the housing receives the foam, is inflated by the pressurized gas and the foam, and is maintained in an inflated condition as the foam hardens. This lightweight portable buoy can be used as a temporary marker by authorities when an obstruction to navigation is found or when permanent buoys are moved or destroyed after a storm.

2 Claims, 3 Drawing Sheets

INFLATABLE CHEMICAL FOAM INJECTED BUOY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to buoys rapidly deployed to mark a site. More particularly, the buoy of this invention is inflated with chemical foam to resist deterioration and/or destruction.

Buoys are routinely used to mark the location of submerged objects for recovery or repair, channels, underwater obstacles, etc. Often, divers and crew members on patrol and/or recovery craft immediately need buoys to mark these features. But, most buoys tend to be rugged structures built to survive the hostile marine environment, and consequently, their size and bulk prevent many of them from being stored or carried by hand or on a smaller craft.

Currently, inflatable marker buoys are commercially available as a replacement for the bulky rigid buoys. These devices are inflated using a gas cartridge (usually $CO_2$). They are compact enough to allow a diver to carry one or more of these buoys and inflate them underwater to mark a spot. However, once inflated, the bladder of the gas filled buoys are susceptible to being punctured and as a result may deflate and sink. Also, over a period of time, the gas filled buoys may fully or partially deflate due to leakage.

Thus, in accordance with this inventive concept, a need has been recognized in the state of the art for a lightweight marker buoy inflated with foam that hardens to be resistant to deflation and sinking if punctured.

SUMMARY OF THE INVENTION

The present invention provides a buoy system to mark a site in water. A pair of chemical injector/cartridges each contains a different chemical compound of a binary chemical compound for producing foam. A housing mounts the pair of chemical injector/cartridges on it and has a chamber to mix the different compounds of the binary chemical compound to produce the foam. A balloon coupled to the housing receives the foam, is inflated by the foam and is maintained in an inflated condition as the foam hardens.

An object of the invention is to provide a lightweight inflatable marker buoy that is resistant to deflation and sinking if punctured.

Another object is to provide a marker buoy inflatable with chemical foam that hardens to prevent deflation and sinking.

Another object of the invention is to provide a foam-filled marker buoy that may be used by a diver while underwater, or delivered by air or dropped over the side of a boat and activated by a timer or on command by electronic or acoustic means.

Another object of the invention is to provide a quickly deployed, foam-filled buoy used as a temporary marker when an obstruction to navigation is found or when permanent buoys are moved or destroyed after a storm.

Another object is to provide a buoy inflatable with chemical foam that has hardened to prevent deflation and sinking if the inflated bladder is punctured.

Another object of the invention is to provide a marker buoy filled with hardened chemical foam to prevent deflation and sinking and to remain small with only added size and weight of chemical injectors/cartridges, valve mechanisms, and mixing chamber.

Another object of the invention is to provide a marker buoy filled with chemical foam that has hardened to prevent deflation and sinking and to maintain rigidity as compared to a buoy filled with gas.

Another object is to provide a marker buoy inflatable with chemical foam from chemical injectors/cartridges and mixing chamber to prevent deflation and sinking.

Another object is to provide a marker buoy inflatable with chemical foam from premixed chemical foam agents requiring moisture to cure to prevent deflation and sinking.

These and other objects of the invention will become more readily apparent from the ensuing specification when taken in conjunction with the appended claims.

DESCRIPTION OF THE PREFERRED EMBODIMENT

Figure 1:
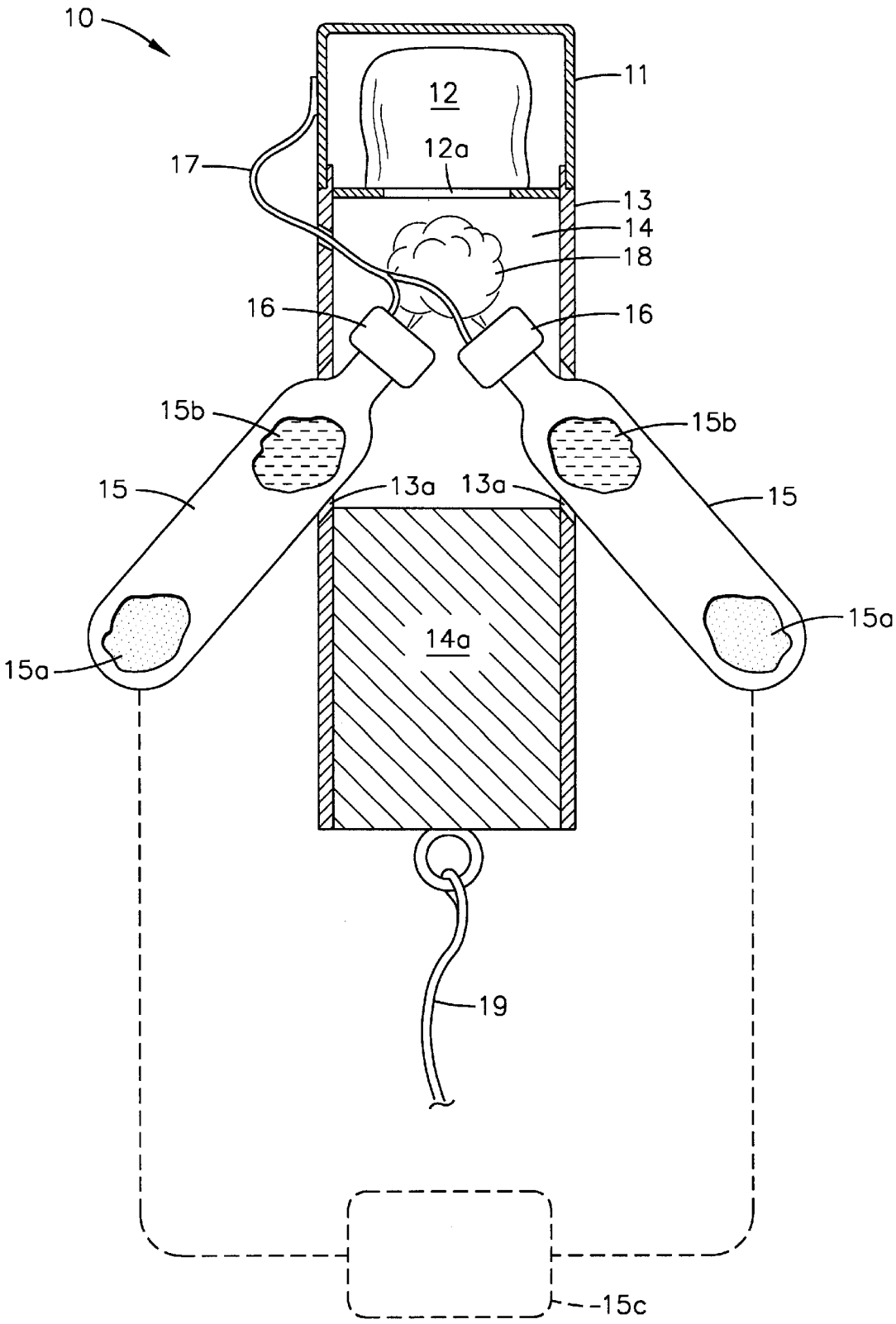
FIG. 1 is a cross-sectional view of the foam inflatable buoy, according to this invention.

Referring to FIG. 1, buoy system 10 has cap 11 covering resilient balloon, or shaped bladder 12. Balloon 12 is shown deflated and folded and may be fabricated from rubber or some other elastic material that can be filled to provide flotation for buoy system 10.

Balloon 12 has its mouth 12*a* connected to housing 13 which has internal chamber 14. Housing 13 mounts a pair of chemical injector/cartridges 15 to extend into chamber 14 by fitting them in appropriately shaped openings 13*a* in housing 13. Chemical injector/cartridges 15 are pressurized with gas 15*a* and each contains a different chemical compound 15*b*.

When different chemical compounds 15*b* of both of injector/cartridges 15 are combined, a binary chemical compound is created that produces chemical foam 18 that hardens after a predetermined period of time. Many different foam producing binary chemical compounds are known in the art, and most are the product of combining two different compounds that are also known in the art. For examples, North Carolina Foam Industries of Mt. Airy, N.C. markets a suitable binary compound under the product-designation NCFI 811-91-3.3, and Clear Coat Company of St. Petersburg, Fla. markets another suitable binary product under the product designation 1 POLY-U-FOAM. Accordingly, selection and/or combination of these and/or other well known compounds to produce foam that later sets, or hardens can be made in accordance with this invention.

Valve mechanism 16 is coupled to each chemical injector/cartridges 15 to selectively feed pressurized gas 15*a* and different chemical compound 15*b* of each chemical injector/cartridge 15 to chamber 14 of housing 13. Valve mechanisms 16 can be made to be actuated by lanyard 17, or they can be made to be responsive to actuation by a timer, or remotely transmitted electrical or acoustic signals as needed.

Figure 2:
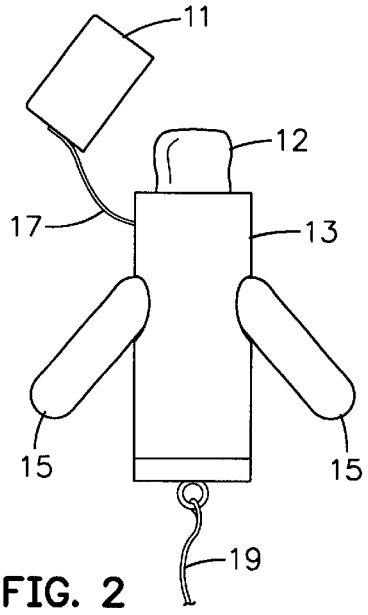
FIGS. 2, 3, 4, and 5 depict the sequence of deployment of buoy system of this invention.
Figure 3:
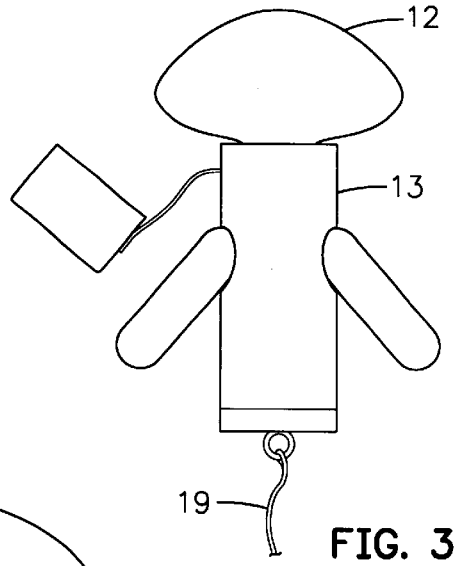
Figure 4:
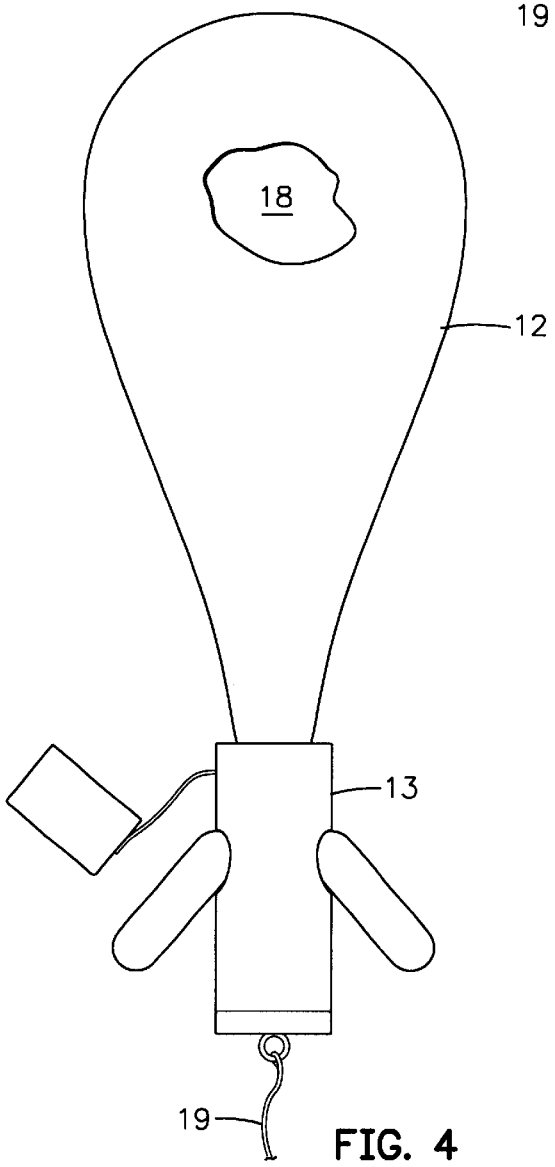
Figure 5:
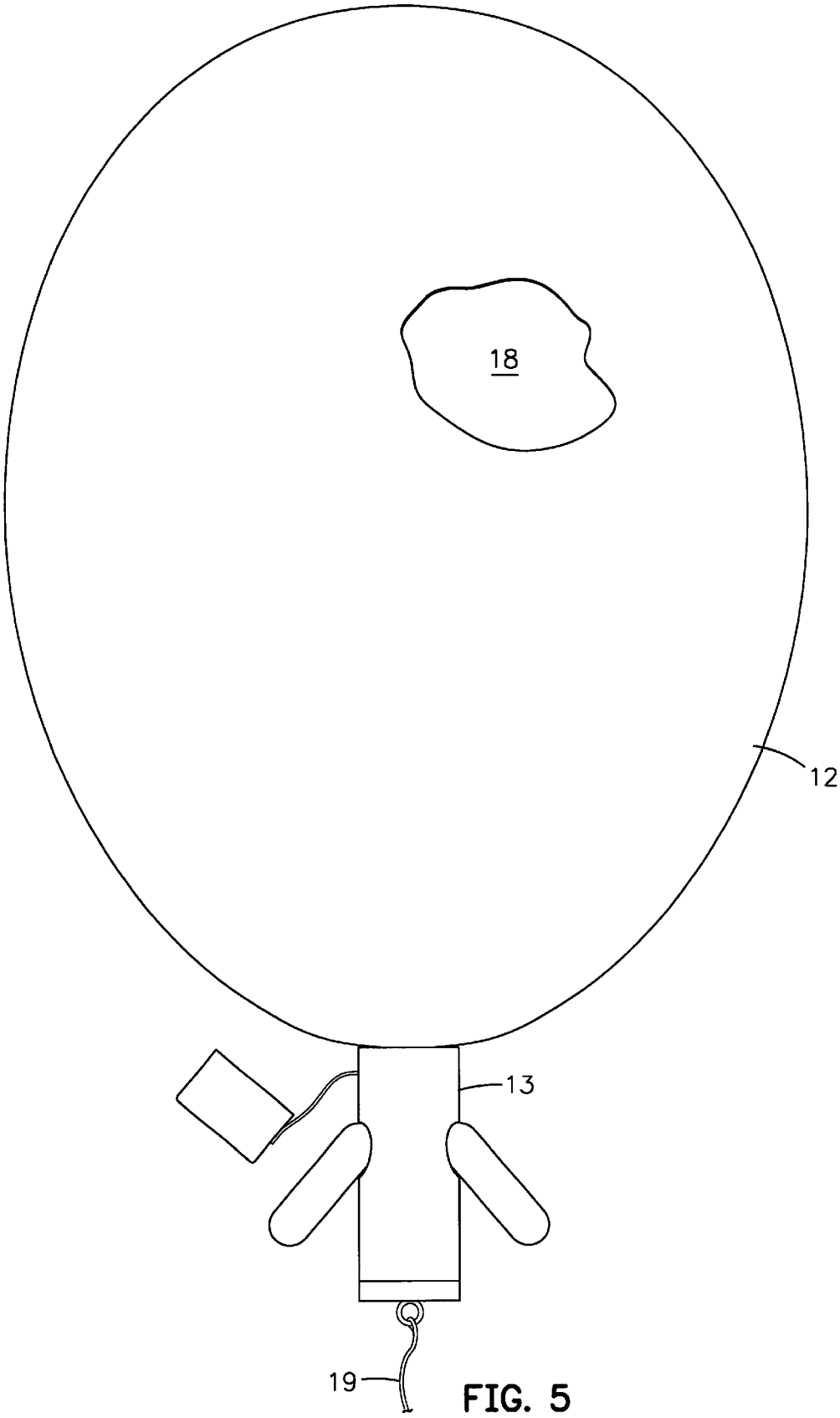

Valve mechanisms 16 are actuated, for example, when lanyard 17 is pulled by a diver while underwater, see FIG. 2. Pulling lanyard 17 connected to mechanisms 16 releases different chemical compounds 15*b* from chemical injectors/cartridges 15 that mix to produce binary foam 18. In other words, pressurized gas 15*a* and different chemical compounds 15*b* from both chemical injector/cartridges 15 are vented into and mixed in chamber 14. This mixing produces a slurry of foam 18 that is injected into balloon 12, also see FIG. 3. Balloon 12 is inflated and filled with foam 18 which has the chemical properties that cause it to begin to solidify, also see FIGS. 4 and 5. After balloon 12 is filled with foam 18 and has risen to the surface of the water, solidification of the foam continues until it hardens. Line 19 couples buoy system 10 to an anchor (not shown).

Commercially available inflatable buoys can be modified into buoy system 10 if the conventional gas inflation device is replaced with two chemical injector/cartridges 15. Buoy system 10 includes two chemical injectors/cartridges 15 for the two different compounds 15*b* and mixing chamber 14. Pressurized gas 15*a* in chemical injector/cartridges 15 provides sufficient pressure to force the two different chemical compounds 15*b* into mixing chamber 14 and foam 18 that is produced into balloon/bladder 12. Optionally, if injector/cartridges 15 are not pressurized, then pressurized gas from a third cartridge 15*c* will be included, see FIG. 1. Pressurized gas from third cartridge 15*c* forces different chemical compounds 15*b* from both injector/cartridges 15 to mix and combine in mixing chamber 14 to form foam 18 and injects foam 18 into balloon/bladder 12, see FIG. 1.

A further option is to provide heat source 14*a* adjacent chamber 14. Heat source 14*a* may include suitable heating coils (not shown) connected to batteries (not shown) to generate heat. This heat from heat source 14*a* may be needed to heat mixing chamber 14, as well as the separate chemicals in chemical injectors/cartridges 15, because some chemical foam compounds 15*b* require certain temperature ranges to combine and/or cure. Heat source 14*a* might also be chemicals that also could be activated by lanyard 17, or some other suitable means to produce heat for raising the temperature of the binary chemicals to aid in the production of foam 18. In either case, chemical foam 18 is preferably of the type that will rapidly cure and harden once balloon 12 inflated.

Some premixed chemical foam compounds 15*b* may require moisture to create foam 18 and cure and harden it. If this type of foam compound is used, then only one chemical injector/cartridge 15 with a valve mechanism 16 may be needed to contain and vent this chemical compound 15*b*. Mixing chamber 14 need only have valve mechanism 16 without another injector/cartridge 15 to allow an appropriate amount of ambient water to be vented into chamber 14 and mix with the foam compound and produce foam 18.

Buoy system 10 of this invention produces a lightweight inflatable marker buoy that is filled with hardened foam 18 to be resistant to deflation and sinking if punctured. Buoy system 10 will most likely be used by a diver while underwater, but could be air delivered or dropped over the side of a boat and be activated by a timer or on command by electronic or acoustic means. Since buoy system 10 is compact, it can be carried on patrol and rescue craft by authorities. This feature permits immediate use of buoy system 10 as a temporary marker when an obstruction to navigation is found or when permanent buoys are moved or destroyed after a storm.

Buoy system 10 uses hardened chemical foam 18 to prevent deflation and sinking so that it may remain small with only the added size and weight of chemical injector/cartridges 15, valve mechanisms 16, and mixing chamber 14. Buoy system 10 is durable so that if balloon 12 is punctured, buoy system 10 can still stay afloat. As compared to a conventional buoy filled with gas, hardened foam 18 adds rigidity to buoy system 10 by advantageous inclusion of chemical foam 18, chemical injector/cartridges 15, and valve mechanisms 16 and mixing chamber 14.

Having the teachings of this invention in mind, modifications and alternate embodiments of this invention may be adapted. For examples, buoy system 10 can be made many different sizes, and balloon 12 need not only be made of elastic materials, such as rubber, but instead could be made from flexible, compliant materials shaped as a bag. These flexible, compliant materials could be plastic, or the plastic-like materials that life jackets are made from or the foil-like material marketed under the trademark MYLAR that additionally will act as a reflector for radar signals. In addition, these flexible materials can have a weave or fabric of fibers embedded in them for reinforcing them.

The disclosed components and their arrangements as disclosed herein all contribute to the novel features of this invention. Buoy system 10 provides an inexpensive way to reliably mark a site without imposing burdensome weight and size constraints. Therefore, buoy system 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A buoy system for marking a site comprising:

a pair of chemical injector/cartridges, each containing a different chemical compound of a binary chemical compound for producing foam;

a housing mounting said pair of chemical injector/cartridges thereon having a chamber to mix said different chemical compounds of said binary chemical compound to produce said foam;

a balloon coupled to said housing to receive said foam therein, said balloon being inflated by said foam and maintained in an inflated condition as said foam hardens therein;

a valve mechanism connected to each of said chemical injector/cartridges to selectively vent each different chemical compound to said chamber; and a cartridge of pressurized gas coupled to each of said chemical injector/cartridges to force said different chemical compounds into said chamber.

2. A buoy system for marking a site comprising:

a chemical injector/cartridge containing pressurized gas and one chemical compound of a binary chemical compound for producing foam;

a housing having a chamber;

a pair of valve mechanisms mounted on said housing, one of said valve mechanisms being connected to said chemical injector/cartridge to selectively vent said one chemical compound to said chamber and the other of said valve mechanisms being connected to feed ambient water to said chamber, said one chemical compound and said ambient water being mixed in said chamber to produce said foam; and a balloon coupled to said housing to receive said foam therein, said balloon being inflated by said foam and maintained in an inflated condition as said foam hardens therein.

* * * * *